US006074054A

United States Patent [19]

Katsuyama

[11] Patent Number: 6,074,054

[45] Date of Patent: Jun. 13, 2000

[54] TRANSPORTING APPARATUS AND IMAGE-FORMING APPARATUS

[75] Inventor: Hitoshi Katsuyama, Tokyo, Japan

[73] Assignee: Canon Kabushiki Kaisha, Tokyo, Japan

[21] Appl. No.: 08/879,606

[22] Filed: Jun. 20, 1997

[30] Foreign Application Priority Data

Jun. 21, 1996 [JP] Japan ..... 8-161599
Jun. 17, 1997 [JP] Japan ..... 9-159746

[51] Int. Cl.[7] ..... B41J 11/24

[52] U.S. Cl. ..... 347/104; 347/16; 226/145; 226/170

[58] Field of Search ..... 347/104, 106, 347/16; 226/145, 147, 170; 346/136

[56] References Cited

U.S. PATENT DOCUMENTS 5,345,863 9/1994 Kurata et al. ..... 101/126

FOREIGN PATENT DOCUMENTS 62-146657 6/1987 Japan .
7-157129 6/1995 Japan .

*Primary Examiner*—John Barlow
*Assistant Examiner*—Christina Annick
*Attorney, Agent, or Firm*—Fitzpatrick, Cella, Harper & Scinto

[57] ABSTRACT

An image forming apparatus is provided with an endless belt conveying a sheet and a drive roller and driven roller supporting the endless belt. A brake is provided for the driven roller and the drive roller is driven by a drive unit which is controlled so as to repeat driving status and stopping status thereof mutually and to make the brake work when the driving unit is at the stopping status.

19 Claims, 4 Drawing Sheets

TRANSPORTING APPARATUS AND IMAGE-FORMING APPARATUS

BACKGROUND OF THE INVENTION

1. Field of the Invention

The present invention relates to a transporting apparatus for conveying a member by means of an endless belt, and an image-forming apparatus using the transporting apparatus.

2. Description of Related Art

As is known in the art, in an image-forming apparatus such as copiers or printers, a recording medium like recording paper or cloth is transported to a recording means where desired image is recorded on the recording medium, and thereafter further transported so as to be discharged therefrom. The transportation of the recording medium is generally carried out such that the recording paper is grasped between a pair of rollers and conveyed thereby. Alternatively, in the case where cloth or the like is used as the recording medium, the cloth is adhered to a rotating endless belt spanned under tension between drive and driven rollers, so as to be transported therewith.

In the transporting apparatus using th(e afore-mentioned endless belt, the recording medium is tensioned (back tension) on a side of a feeding roller so as not to cause wrinkles on the recording medium when the recording medium is fixedly adhered onto the endless belt. For this reason, when the endless belt is constructed by a non-metallic member, there arises such a problem that the tension force exerted on the endless belt by the tensioned recording medium induces undesired elongation of the endless belt so that the transportation accuracy of the recording medium tends to be adversely affected.

In order to prevent the adverse influence due to the tension force exerted by the recording medium, the drive and driven rollers are coupled with a D.C. motor, a pulse generator, a digital servo mechanism or the like to control the transportation. However, these devices and mechanisms or control methods therefor are complicated.

On the other hand, when the endless belt is constructed by a rigid metallic member, such an endless belt exhibits a small elongation when exposed to the tension force by the recording medium. However, the metallic endless belt is expensive, resulting in increased production cost of the apparatus as a whole.

Further, in addition to the adverse influence by the back tension, if the apparatus becomes large in size, the rotation of the driven roller creates a large inertia force, so that only the driven roller is continuously rotated by the effect of the inertia force even when the drive roller is stopped. This tends to deteriorate the transportation accuracy.

SUMMARY OF THE INVENTION

The present invention has been made in order to eliminate the afore-mentioned problems encountered in the prior art.

Therefore, it is an object of the present invention to provide a transporting apparatus having a simple configuration and capable of reducing the adverse influence cue to elongation of an endless belt to enhance the transportation accuracy, and an image-forming apparatus using the transporting apparatus.

To accomplish the afore-mentioned objects, a representative constitution of the present invention is characterized by a transporting apparatus for conveying a member by means of a rotating endless belt spanned under tension between two or more rollers, which apparatus comprises a drive roller constituting one of each of the two or more rollers, the drive roller intermittently applying a rotational force to the endless belt and being located on a downstream side of the transporting apparatus in the transportation direction of said member to be transported; a driven roller constituting the other of each of the two or more rollers, the driven roller being followable with the rotational movement of the endless belt and located on an upstream side of the transporting apparatus in the transportation direction; and a rotation braking means coupled with the driven roller.

With the afore-mentioned constitution of the present invention, when the member to be transported is adhered onto the endless belt, the driven roller located on an upstream side of the transporting apparatus along the transportation direction is kept stopped by a braking means, thereby shielding the endless belt from an external force and therefore preventing the endless belt from being elongated.

DETAILED DESCRIPTION OF THE PREFERRED EMBODIMENTS

The transporting apparatus and the image-forming apparatus using the transporting apparatus according to preferred embodiments of the present invention will now be described in detail with reference to the accompanying drawings.

Figure 1:
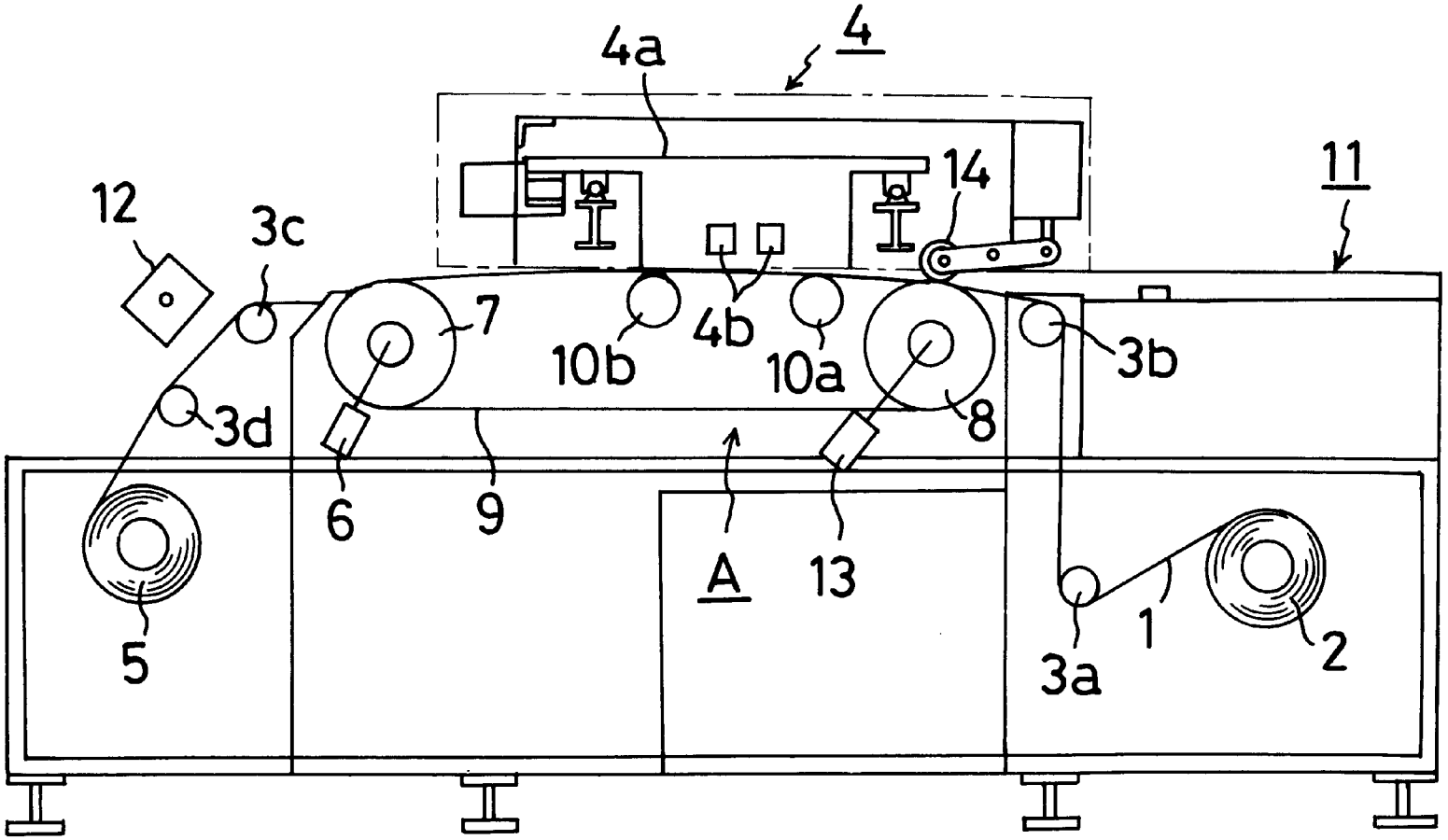
FIG. 1 is a side view schematically showing an image-forming apparatus using a transporting apparatus according to one preferred embodiment of the present invention.

Referring to FIG. 1, there is schematically shown in section an ink jet printing apparatus which is one preferred embodiment of the image-forming apparatus according to the present invention.

The image-forming apparatus is adapted so as to transport elongated cloth 1 and record a desired image thereon. In the image-forming apparatus, cloth 1 rolled on a feeding roller 2 is drawn off by rotating the feeding roller 2 and sequentially delivered toward the transporting apparatus A through intermediate rollers 3*a* and 3*b*. The cloth 1 fed from the feeding roller 2 is conveyed by the transporting apparatus A. Then, desired images are recorded on the cloth 1 by means of a recording means 4. After recording, the cloth 1 on which the images are recorded is delivered through another pair of intermediate rollers 3*c* and 3*d* and wound around a winding roller 5.

The transporting apparatus A comprises a drive roller 7 coupled to a servo motor 6 and rotatably driven thereby, a freely-rotatable driven roller 8 and an endless belt 9 spanned under tension between the drive and driven rollers 7 and 8. As shown in FIG. 1, when the drive roller 7 is operated to rotate in the counterclockwise direction, the upper-run of the endless belt 9 is moved toward the winding roller 5 to convey the cloth 1 carried thereon. The endless belt 9 is constructed by a non-metallic member such as a reinforced rubber and an adhesive layer formed on a surface of the non-metallic member. The cloth 1 fed from the feeding roller 2 is pressed against the adhesive layer of the endless belt 9 by an attaching roller 14 so as to be brought into intimate contact therewith. As a result, the cloth 1 can be transported without floating apart from the surface of the endless belt 9.

Incidentally, the endless belt 9 is guided by platen rollers 10*a* and 10*b* in a predetermined region opposed to a recording means 4, so that the corresponding portion of the endless belt 9 is adequately tensioned, thereby permitting the cloth 1 to be transported in the horizontal direction.

The recording means 4 according to the preferred embodiment of the present invention is constructed by an ink jet printing system in which ink is ejected from a recording head. Specifically, the recording head is provided with fine discharge ports (orifices), liquid passages each having an energy-applied section and an energy-generating means for generating a droplet-forming energy which is exerted on the ink located in the energy-applied section.

As the energy-generating means, there can be used an electromechanical transducer such as a piezoelectric element, an energy-generating means capable of ejecting ink droplets by the effect of heat generated by irradiating an electromagnetic wave such as laser to the ink, an energy-generating means capable of ejecting ink droplets by heating the ink by means of an electrothermal transducer such as an exothermic element having a exothermic resistance, or the like.

Among the recording heads equipped with such energy-generating means, recording heads capable of ejecting ink droplets by the application of heat energy are preferably used, because discharge ports (orifices) for ejecting droplets of the recording liquid can be arranged with a high density on the head, thereby enabling images having a high definition to be recorded. Among them, the recording heads in which electrothermal transducers are used as the energy-generating means is more preferably used, because they can be readily minimized in size and mounted with a high density, and because the production cost therefor is advantageously low.

Meanwhile, the ink jet printing apparatus according to the preferred embodiment of the present invention is so designed that the electrothermal transducer is energized in response to recording signals to cause film boiling of the ink by applying the thermal energy thereto, thereby allowing expansion and shrinkage of bubbles in the ink, which forces the ink to be ejected through discharge ports for recording.

The recording means 4 comprises two recording heads 4*b* mounted on a carriage which is movable in the direction perpendicular to the transporting direction of the cloth 1 (i.e., the direction vertical to a paper plane of FIG. 1). While the carriage 4*a* is moved in the afore-mentioned direction relative to the cloth 1 carried on the endless belt 9, ink droplets are ejected from the recording head 4*b* to form images having a given length (a recording width) in the transporting direction of the cloth 1. The image formation by the recording means 4 is carried out in such a condition that the endless belt 9 is stopped to hold the cloth 1 at a predetermined recording position where the recording head 4*b* is opposed thereto. After the recording operation is finished, the transporting apparatus A carries the cloth 1 by the recording width for moving the next area of the cloth 1 to be recorded to the recording position. The transporting apparatus A performs this recording-width carrying operation each time after the recording operation is performed. Thus, the transporting apparatus A repeats its operating status and stopping status and the cloth 1 which is carried thereby intermittently moved. Incidentally, the recording means 4 is also movable in the right to left direction of FIG. 1, so as to facilitate replacement of the endless belt 1 or the like. In addition, in the afore-mentioned movable range of the recording means 4, there is provided an HS station 11 for compensating or correcting non-uniformity of the concentration of ink ejected from the recording head 4*b*.

The HS station 11 is provided with a sheet-like printing medium (HS sheet) for forming a test pattern thereon. The HS sheet is adhered onto an attaching plate made of metal or resin and having a plain surface through a double-coated tape, an adhesive or the like, so as not to float from the surface of the attaching plate. When HS treatment is performed, the recording means 4 is moved to the HS station 11 to print the test pattern on the HS sheet. After forming the test pattern on the HS sheet, the recording means 4 is moved back to a normal printing position thereof to remove the HS sheet from the HS station. The test pattern printed on the HS sheet is read out by a reading means provided in a separate system to obtain correction data for respective discharge ports. The correction data is used to correct print data, thereby permitting the recording head to be driven in an appropriate manner.

The cloth 1 on which desired images have been recorded by the recording means 4 is further guided by the intermediate roller 3*c*, thereby permitting the cloth to be separated from the adhesive layer of the endless belt 9 at a position at which the drive roller 7 is located. The cloth 1 is then wound around the winding roller 5. Between the intermediate rollers 3*c* and 3*d*, there is provided a heater 12 from which a hot air is blown toward the cloth 1 to dry the ink images formed thereon by the recording means 4. Therefore, the cloth on which the ink images are formed by the recording means 4 is wound around the winding roller 5 in a dried state. Incidentally, as the heater 12, there can also be suitably used an infra-red irradiating device or the like in addition to the afore-mentioned hot-air blowing device.

Here, the tension exerted on the endless belt 9 when the cloth 1 is transported thereby will be described with reference to FIG. 2.

Figure 2:
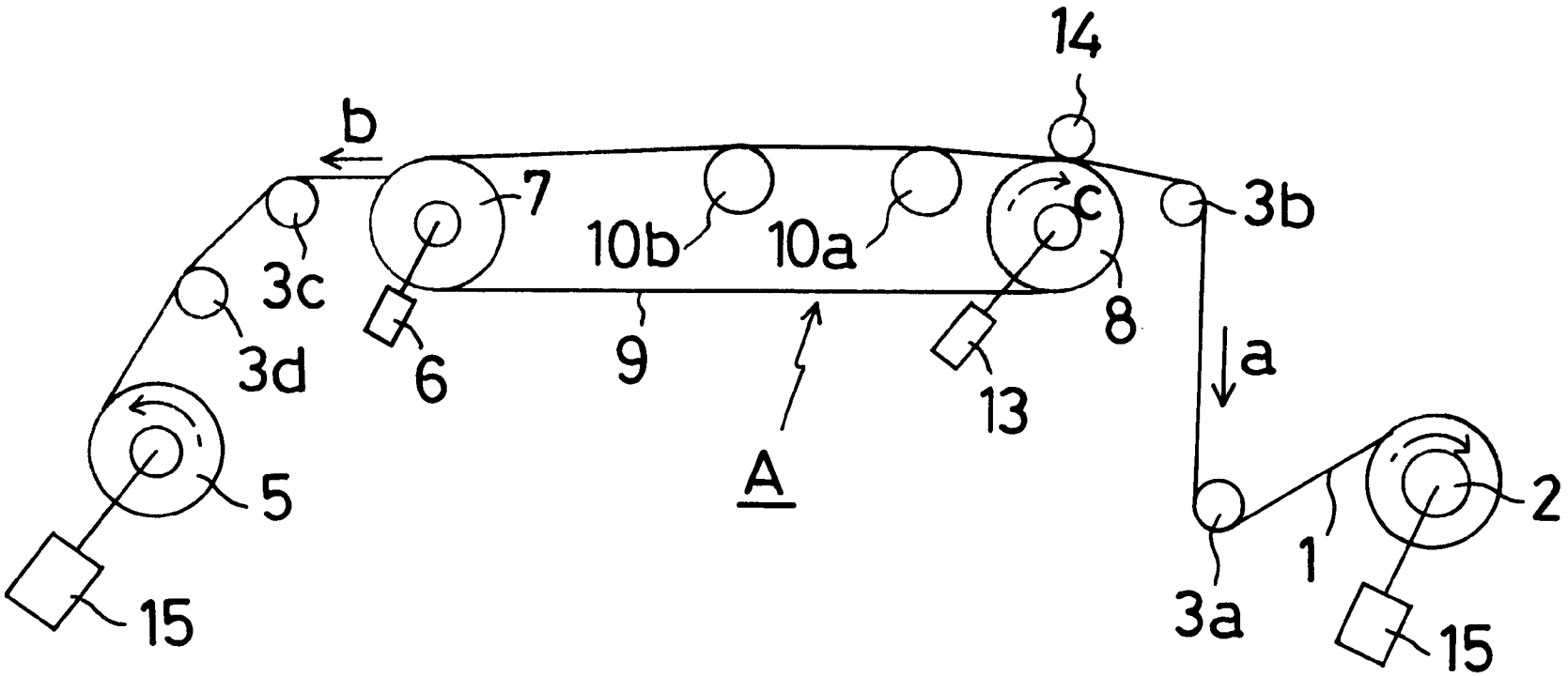
FIG. 2 is a side view of a transporting apparatus explaining tension exerted on the endless belt.

The feeding roller 2 is loaded by a friction clutch 15 as a tensioning means in the direction reverse to the feeding direction of the cloth 1 (i.e., the direction indicated by an arrow "a" in FIG. 2). For this reason, the feeding roller 2 exerts a back tension onto the cloth 1, thereby preventing the cloth 1 from causing looseness thereof. Further, the intermediate roller 3*a* acts to stretch and eliminate wrinkles formed on the cloth 1.

On the other hand, another friction clutch 15 as a tensioning means is also provided to apply a torque to the winding roller 5 such that the winding roller 5 can be rotated at a slightly larger rotational speed than that of the endless belt 9. For this reason, a front tension is applied to the cloth 1 to be wound around the winding roller, in the direction indicated by an arrow "b" in FIG. 2. This not only facilitates the separation of the cloth 1 from the endless belt 9 but also prevents the cloth 1 from being loosely wound on the winding roller 5.

As described above, the back and front tensions applied to the cloth 1 are directly exerted on the endless belt 9. When the back tension is increased and becomes larger than the front tension, the endless belt 9 is tensioned so as to be urged in the direction reverse to the transportation direction of the cloth. In this case, when the non-metallic endless belt is used, the endless belt 9 is readily stretched and therefore displaced in the direction indicated by an arrow "c" in FIG. 2. At this time, since the frictional force between the endless belt 9 and a outer surface of the driven roller 8 is larger than the belt tension caused due to the back tension, there occurs no slippage between the endless belt 9 and the driven roller 8. As a result, the driven roller 8 is forced to rotate in the direction reverse to the feed direction of the cloth 1 by the action of the tension force applied to the endless belt 9.

Thus, in the case where the endless belt 9 is adversely influenced by the back tension, there arises an inconvenience that the cloth 1 rested on the endless belt cannot be stopped at the aimed position, thereby resulting in deteriorated transportation accuracy. When images are recorded on the cloth 1 by the recording means, the cloth 1 is moved back from the aimed position. This causes such a problem that a leading edge of one recording region on the cloth 1 overlaps over a trailing edge of the preceding recording region on which images have been already recorded, whereby stripe patterns are undesirably formed on the overlapped portion.

Figure 3:
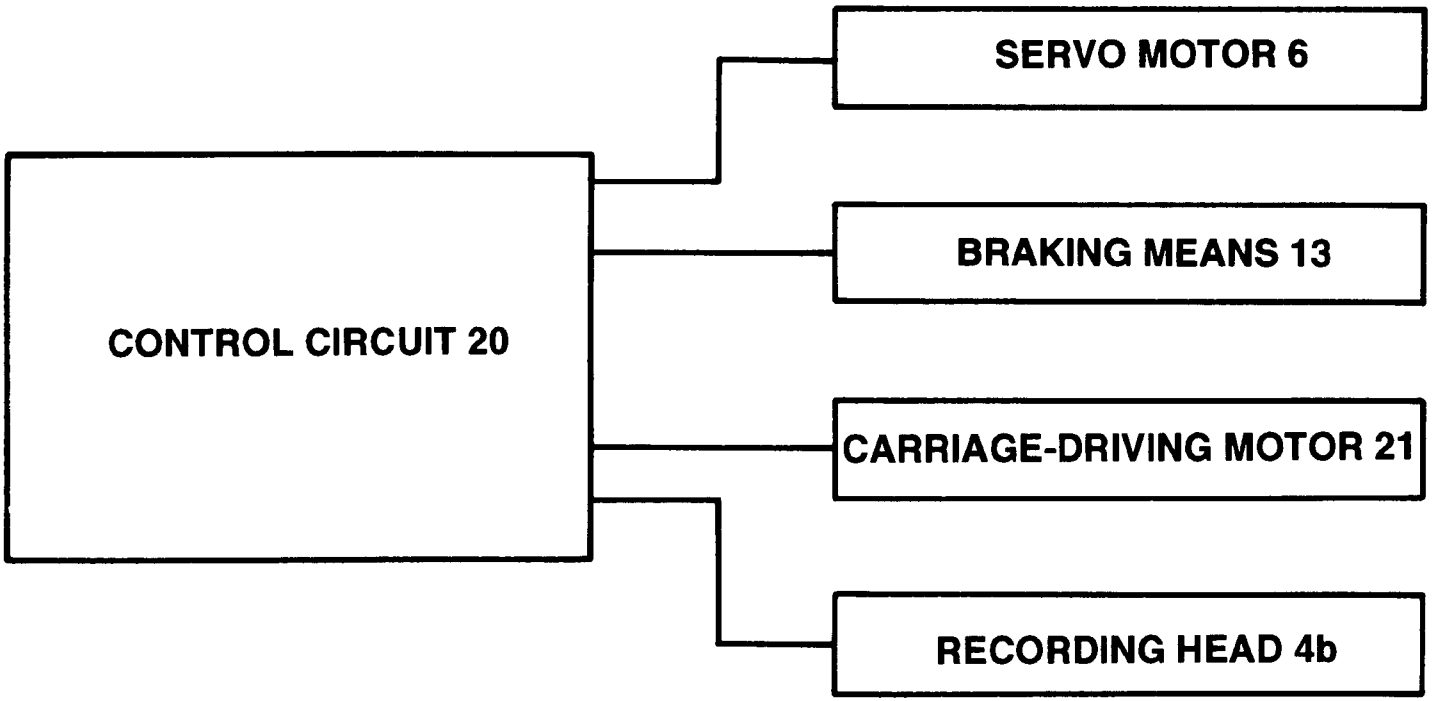
FIG. 3 is a block diagram showing the image forming apparatus.
Figure 4:
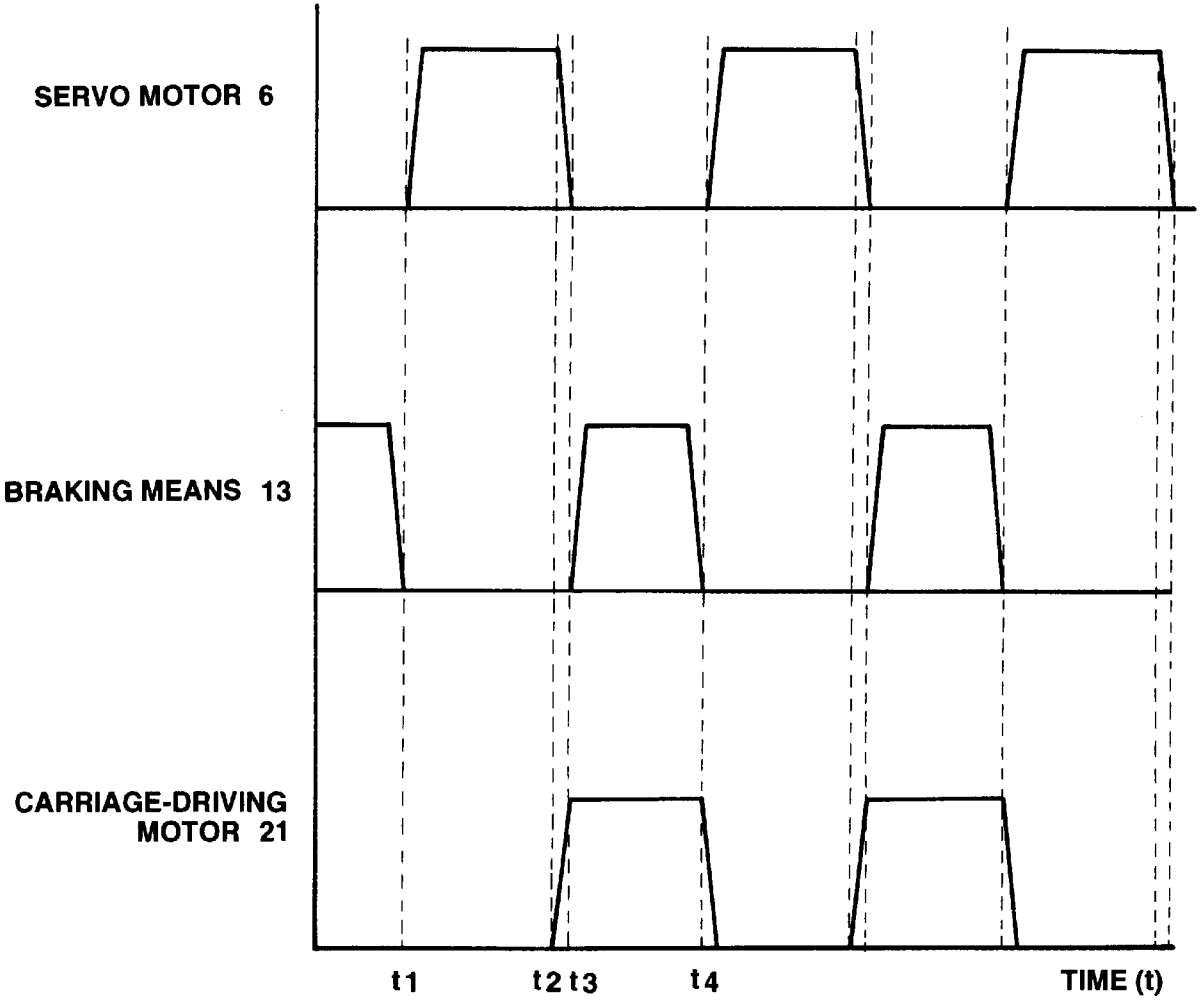
FIG. 4 is a timing chart thereof. With reference to these drawings, operations by the image-forming apparatus.

FIG. 3 is a block diagram showing the image forming apparatus of the present embodiment and FIG. 4 is a timing chart thereof. With reference to these drawings, operations by the image-forming apparatus of the present embodiment is described in detailed hereinafter.

As shown in FIG. 3, the servo motor 3, the braking means 13, a carriage-driving motor 21 for moving the carriage 4*a* of the recording means 4 and the recording head 4*b* thereof is respectively connected to a control circuit 20.

Referring to FIG. 4, at a time t1, a control circuit 20 as a control means controls so that the servo motor 6 starts moving to rotate the drive roller 7. Previous to the time t1, a brake-cancelling signal should be transferred to the braking means 13 to remove braking force before the servo motor 6 starts rotation thereof.

At time t2, the control circuit 20 starts reducing rotating speed of the servo motor 6. The control circuit 20 controls the servo motor 6 to down the speed with watching the rotating speed of the servo motor 6 by an encoder not shown in drawings. At time t3, when it is perceived by the encoder that the servo motor 6 reduces the speed virtually to be stopped, the braking means 13 would be set to work. For this period from starting the rotation of the servo motor 6 till stopping thereof, the endless belt 9 carries the cloth 1 by the recording width.

Also, the control means 20 transmits a drive command signal to the carriage-driving motor 21 at the time t2. The recording head 4*b* mounted on the carriage 4*a* shifts a recording position to form images on the area to be recorded of the cloth 1 corresponding to image information sent from the host computer. At a time t4 which is after the recording head 4*b* passes a whole width of the cloth 1, the control means 20 starts driving the servo motor 6 moving as it was at the time t1. Prior to this action, the control means 20 would cancel the working status of the braking mean 13.

Repeating this action, the image-forming apparatus could form images on cloth 1 in series of the transporting direction thereof.

In view of the afore-mentioned problems, in the preferred embodiment of the present invention, the driven roller 8 is operably coupled with a braking means 13 to prevent the reverse rotation thereof. That is, when the cloth 1 is transported by the rotational movement of the endless belt 9, the braking operation by the braking means 13 is released to permit a smooth transportation of the cloth 1. Successively, immediately after the rotation of the endless belt 9 is interrupted to record images on the cloth 1 by the recording means 4, the braking means 13 is actuated to lock the driven roller 8 and stop the rotation thereof, thereby preventing the endless belt 9 from being adversely affected by the back tension. The braking means 13 unlock the driven roller 8 immediately before the endless belt 9 starts to rotate again from the stopped condition. The braking means 13 repeatedly performs the afore-mentioned operations in synchronism with the transporting and stopping operations of the transporting apparatus A. Incidentally, in the preferred embodiment of the present invention, a dry single disc brake of a type which is operated upon excitation can be used as the braking means 13.

With the afore-mentioned arrangement, even though a magnitude of the back tension exerted on the cloth 1 wound around the feeding roller 2 is changed, the driven roller 8 can be prevented from rotating in the direction reverse to the transportation direction of the cloth 1 since the braking means 13 locks the driven roller 8 upon stoppage thereof. This prevents the deterioration in transportation accuracy.

On the other hand, a servo motor is used as the motor 6 for rotating the drive roller located on the winding or take-up side of the cloth 1. For this reason, even though the front tension applied to the endless belt 9 is increased, the drive roller 7 is inhibited from rotating in association with the increased front tension. This is because the servo mechanism is operated such that the position of the drive roller 7 remains unchanged.

Meanwhile, when the length of the endless belt 9 becomes small, the belt-feeding error, which is caused due to the difference in elongation of the endless belt 9 between respective intermittent driving operations of the transporting apparatus or the difference in degree of shrinkage of the belt between respective stopping operations thereof, can be reduced as compared to the case where the endless belt having an increased length is used. Therefore, the use of the endless belt 9 having a small length is more preferable to enhance the transportation accuracy, because such an endless belt is much less influenced by the afore-mentioned tension forces.

In the above preferred embodiment, although rubber is exemplified as a material for the endless belt 9, the endless belt 9 usable in the present invention is not limited to the particular ones. In the present invention, other configurations such as seamless endless belts produced by centrifugal molding method and made of a polymeric material, e.g., polyimide, or seamless endless belts produced by a heat-welding method or the like and made of a polymeric material, can also be selectively used.

In addition, in the afore-mentioned preferred embodiment, the ink jet printing system is used as the recording means. However, the recording system usable in the present invention is not limited to the particular ones. For instance, any other recording systems such as an electrophotographic recording system or a thermal transfer recording system can also be used in the present invention. Further, the recording medium on which images are formed by the recording means according to the present invention should not be limited to cloth. Such an image-forming apparatus can be applied to various types of recording media such as papers, plastic sheets or the like.

Furthermore, the transporting apparatus using the endless belt according to the present invention can also be applied not only to the afore-mentioned image-forming apparatus equipped with the recording means, but also to any other types of apparatus, for example, an image reader in which a sheet-like original document is transported to read images therefrom, or the like.

As described above, in accordance with the present invention, since the driven roller is disposed on an upstream side of the transporting apparatus in the transportation direction of the member to be transported and further the rotation-braking means is coupled with the driven roller, the transporting apparatus can be prevented from being adversely affected by the tension forces exerted on the endless belt, thereby enhancing the transportation accuracy. Accordingly, in the case where the member to be transported is a recording medium and images are recorded thereon, it is possible to form images having an improved quality. Alternatively, in the case where the member to be transported is an original document from which information is read out, it is also possible to enhance the read-out accuracy.

Also, since the apparatus according to the present invention has a simple structure, the increase in production cost therefor can be avoided. Further, since the transportation accuracy is not deteriorated even in the case where a non-metallic member is used as the endless belt, it is possible to achieve further decrease in the production cost therefor. Accordingly, by using the afore-mentioned transporting apparatus, such an image-forming apparatus which has a high transportation accuracy and is capable of forming images having a high quality, can be produced at a low cost.

It is to be noted that although the most preferred embodiment according to the invention is described, persons skilled in the art may consider other constitution or modifications. Therefore, this invention is no, restricted to the embodiments above, other variations are covered as far as within the scope of the following claims.

What is claimed is:

1. A transporting apparatus for conveying a member in a transporting direction, comprising:

a drive roller;

a driven roller;

a rotating endless belt spanned under tension between said drive roller and said driven roller;

driving means for driving said drive roller, thereby applying a rotational force to said endless belt;

control means for controlling said driving means so that said drive roller intermittently applies the rotational force to said endless belt and said drive roller is located on a downstream side of said transporting apparatus in the transportation direction of said member;

said driven roller being followable with the rotational movement of said endless belt and located on an upstream side of said transporting apparatus in the transportation direction; and rotation braking means to lock the driven roller while said drive roller is stopped during the intermittent application of rotational force to the endless belt;

wherein said rotation braking means is disengaged when the drive roller is rotating.

2. A transporting apparatus as claimed in claim 1, further comprising tensioning means for tensioning said member being conveyed so as to be urged toward at least the upstream side of said transporting apparatus in the transportation direction.

3. A transporting apparatus as claimed in claim 1, wherein said endless belt is constructed of a non-metallic member.

4. A transporting apparatus as claimed in claim 3, wherein said endless belt is provided on a surface thereof with an adhesive layer, and said member being conveyed is brought into intimate contact with the surface of said endless belt through said adhesive layer.

5. A transporting apparatus as claimed in claim 1, further comprising a feeding roller which is located on the upstream side of said driven roller in the transportation direction and from which said member in the form of a band is fed, and a winding roller which is located on the downstream side of said drive roller in the transportation direction and on which said member being conveyed is wound.

6. A transporting apparatus as claimed in claim 5, further comprising tensioning means to apply a tension force to a portion of said member being conveyed, which portion is located on the upstream side of said transporting apparatus in the transportation direction.

7. A transporting apparatus as claimed in claim 1, wherein said member being conveyed is cloth.

8. An image-forming apparatus for conveying a member in a transportation direction comprising:

a drive roller;

a driven roller;

a rotating endless belt spanned under tension between said drive roller and said driven roller;

driving means for driving said drive roller thereby applying a rotational force to said endless belt, control means for controlling said driving means so that said drive roller intermittently applies the rotational force to said endless belt and said drive roller is followable with the rotation of said endless belt and located on an upstream said of said transporting apparatus in the transportation direction;

rotation braking means coupled with said driven roller for locking the driven roller while said drive roller is stopped during the intermittent application of rotational force to the endless belt, wherein said rotation braking means is disengaged when said drive roller is rotating; and recording means for performing recording of said member conveyed by said transporting apparatus.

9. An image-forming apparatus as claimed in claim 8, wherein said transporting apparatus further comprises a feeding roller for a band-like member which is located on an upstream side of said driven roller along the transportation direction, and a winding roller for the band-like member which is located on a downstream side of said drive roller in the transportation direction.

10. An image-forming apparatus as claimed in claim 9, wherein said transporting apparatus further comprises a tensioning means coupled with said feeding roller to apply a tension force to a portion of said member to be transported, which portion is located on an upstream side of said transporting apparatus in the transportation direction.

11. An image-forming apparatus as claimed in claim 8, wherein said recording means is movable in a direction perpendicular to the transportation direction of said member to be conveyed, so as to record images on said member.

12. An image-forming apparatus as claimed in claim 11, wherein said drive roller of said transporting apparatus is stopped when said recording means performs recording of said member.

13. An image-forming apparatus as claimed in claim 8, wherein said member to be transported is cloth.

14. An image-forming apparatus as claimed in claim 8 or claim 13, wherein said recording means is an ink jet recording system.

15. A transporting apparatus comprising:

an endless belt for conveying a sheet by rotating while in contact with the sheet;

a drive roller for transmitting a rotating force to the endless belt;

driving means for rotating said drive roller;

a driven roller, wherein said endless belt spans under tension between said drive roller and said driven roller;

braking means for applying a braking force to the driven roller, wherein said rotation braking means is disengaged when the drive roller is rotating; and a control means for controlling the driving means so as to repeat starting and stopping rotation of said drive roller and for controlling the braking means to apply braking to the driven roller when the driving means is stopped.

16. An image-forming apparatus comprising:

an endless belt for conveying a sheet by rotating while in contact with the sheet;

a drive roller for transmitting a rotating force to the endless belt;

driving means for rotating the drive roller;

a driven roller, wherein said endless belt spans under tension between said drive roller and said driven roller;

braking means for applying a braking force to the driven rollers, wherein said braking means is disengaged when the drive roller is rotating;

image-forming means for forming images on the sheet conveyed by said image forming apparatus; and control means to control the driving means so as to repeat starting and stopping rotating of said drive roller and for controlling the braking means to apply braking to the driven roller when the driving means is stopped.

17. An image-forming apparatus as claimed in claim 16, wherein each time the driving means stops, the image-forming means forms images having a predetermined width in a transporting direction of the sheet.

18. An image-forming apparatus as claimed in claim 17, wherein said control means controls the driving means so as to carry the sheet by the predetermined width in the transporting direction thereof driving an interval from when the driving means starts rotating until it stops rotating.

19. An image-forming apparatus as claimed in claim 16, wherein said, image-forming means is disposed between said drive roller and said driven roller.

* * * * *

UNITED STATES PATENT AND TRADEMARK OFFICE

CERTIFICATE OF CORRECTION

PATENT NO. : 6,074,054

DATED : June 13, 2000

INVENTOR(S): HITOSHI KATSUYAMA

It is certified that error appears in the above-identified patent and that said Letters Patent is hereby corrected as shown below:

COLUMN 1:
Line 23, "the(e" should read --the--.

COLUMN 5:
Line 18, "is" should read --are--; and
Line 65, "unlock" should read --unlocks--.

COLUMN 7:
Line 23, "no," should read --not--.

Signed and Sealed this

Tenth Day of April, 2001

*Attest:*

Nicholas P. Godici

NICHOLAS P. GODICI

*Attesting Officer*

*Acting Director of the United States Patent and Trademark Office*